US008702092B2

(12) United States Patent
Asada et al.

(10) Patent No.: US 8,702,092 B2
(45) Date of Patent: Apr. 22, 2014

(54) SHEET FEED DEVICES AND IMAGE RECORDING APPARATUS COMPRISING SUCH SHEET FEED DEVICES

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/607,362

(22) Filed: Sep. 7, 2012

(65) Prior Publication Data

US 2012/0326383 A1 Dec. 27, 2012

Related U.S. Application Data

(63) Continuation of application No. 13/114,017, filed on May 23, 2011, now Pat. No. 8,267,396, which is a continuation of application No. 12/397,341, filed on Mar. 3, 2009, now Pat. No. 7,946,573.

(30) Foreign Application Priority Data

Mar. 31, 2008 (JP) ..... 2008-093411

(51) Int. Cl.
*B65H 3/34* (2006.01)

(52) U.S. Cl.
USPC ..... 271/167; 271/121

(58) Field of Classification Search
USPC ..... 271/10.01, 10.09, 18, 119, 120, 121, 271/167
See application file for complete search history.

(56) References Cited

U.S. PATENT DOCUMENTS

| | | | |
|---|---|---|---|
| 5,895,040 | A | 4/1999 | Oleksa et al. |
| 5,899,450 | A | 5/1999 | Gettelfinger et al. |
| 5,971,390 | A | 10/1999 | Caspar et al. |
| 6,139,007 | A | 10/2000 | Cahill et al. |
| 6,536,757 | B2 | 3/2003 | Chang |
| 6,942,209 | B2 | 9/2005 | Kawakami |
| 6,969,168 | B2 | 11/2005 | Mo et al. |
| 7,036,814 | B2 | 5/2006 | Oh et al. |

(Continued)

FOREIGN PATENT DOCUMENTS

| | | | |
|---|---|---|---|
| JP | 2004-051336 | A | 2/2004 |
| JP | 2006-206220 | A | 8/2006 |
| JP | 2007-091429 | A | 4/2007 |

OTHER PUBLICATIONS

Japan Patent Office, Notice of Reasons for Rejection for Japanese Patent Application No. 2008-093411 (counterpart to U.S. Patent No. 7,946,573 B2), mailed May 12, 2010.

*Primary Examiner* — Michael McCullough
*Assistant Examiner* — Howard Sanders
(74) *Attorney, Agent, or Firm* — Baker Botts L.L.P.

(57) ABSTRACT

A sheet feed device has a tray with holding surface for holding sheets, a feed unit for feeding sheets from the tray, and a separation plate. The separation plate has an inclined surface and two or more separation portions that separate a sheet from the sheets held in the tray. At least one of the separation portions projects a first distance from the inclined surface. The separation plate also has a projection positioned on the inclined surface that projects a second distance from the inclined surface. The second distance is greater than the first distance. A first of the separation portions is positioned upstream of the particular projection in the sheet feed direction, and a second of the separation portions positioned downstream of the particular projection in the sheet feed direction.

15 Claims, 14 Drawing Sheets

(56) References Cited

U.S. PATENT DOCUMENTS

| | | | |
|---|---|---|---|
| 7,152,859 | B2 | 12/2006 | Flynn et al. |
| 7,370,859 | B2 | 5/2008 | Asada |
| 7,435,025 | B2 | 10/2008 | Tanahashi et al. |
| 7,513,495 | B2 | 4/2009 | Mo |
| 7,549,624 | B2 | 6/2009 | Watanabe |
| 2004/0017039 | A1 | 1/2004 | Asada et al. |
| 2004/0032077 | A1 | 2/2004 | Oh et al. |
| 2005/0194734 | A1 | 9/2005 | Asada et al. |
| 2006/0071401 | A1 | 4/2006 | Chikumoto |
| 2006/0164501 | A1 | 7/2006 | Koga |
| 2006/0180992 | A1 | 8/2006 | Asada |
| 2007/0069447 | A1 | 3/2007 | Watanabe |
| 2007/0132172 | A1 | 6/2007 | Mo |
| 2007/0253037 | A1 | 11/2007 | Mo et al. |

SHEET FEED DEVICES AND IMAGE RECORDING APPARATUS COMPRISING SUCH SHEET FEED DEVICES

CROSS REFERENCE TO RELATED APPLICATIONS

This is a continuation application of U.S. patent application Ser. No. 13/114,017, filed on May 23, 2011, which is a continuation application of U.S. Pat. No. 7,946,573, issued on May 24, 2011, which claims the benefit of Japanese Patent Application No. 2008- 093411, which was filed on Mar. 31, 2008, the disclosures of which are incorporated herein by reference in their entirety.

BACKGROUND OF THE INVENTION

1. Field of the Invention

The invention relates generally to sheet feed devices which comprise a tray for storing a stack of sheets therein, a feed roller configured to move toward and away from a bottom surface of the tray and to feed a sheet from the stack in the tray, and a separation member configured to separate the sheet fed by the feed roller from the stack of sheets. The invention also relates to image recording apparatus comprising such sheet feed devices.

2. Description of Related Art

A known sheet feed device, e.g., the sheet feed device described in Japanese Laid-Open Patent Application Publication No. 2006-206220, is used in a known image recording apparatus, such as a printer, a facsimile device, or both. The known sheet feed device includes a feed roller positioned at a free end of a pivotable arm, a tray for storing a stack of sheets therein, an inclined separation plate positioned at a downstream end of the tray in a sheet feed direction, and a substantially U-shaped feed path extending between the separation plate and a recording unit. As the feed roller rotates while contacting an uppermost sheet of the stack in the tray, the separation plate separates the uppermost sheet from the stack in the tray, and the uppermost sheet is fed via the U-shaped feed path to the recording unit.

In a known inkjet recording apparatus, the separation plate has a plurality of separation portions positioned in the sheet feed direction, and a roller positioned on each lateral side of the highest one of the separation portions, e.g. the most downstream one of the separation portions. The distance by which each separation portion projects from the inclined surface of the separation plate is substantially equal to the distance by which each roller projects from the inclined surface of the separation surface.

In such sheet feed device, however, a sheet surface may be damaged by some of the separation portions positioned lower than the rollers especially when a sheet having a relatively high rigidity is fed from a relatively low stack of sheets in the tray.

SUMMARY OF THE INVENTION

Therefore, a need has arisen for sheet feed devices and image recording apparatus that overcome these and other shortcomings of the related art. A technical advantage of the invention is that a sheet is fed from a stack of sheets in a tray toward a feed path while a surface of the sheet is prevented from being damaged by any of separation portions of a separation plate.

According to an embodiment of the invention, a sheet feed device comprises a tray comprising a holding surface configured to hold a plurality of sheets, a feed unit configured to contact a particular sheet of the plurality of sheets, and to feed at least the particular sheet from the tray in a sheet feed direction, and a separation plate positioned at a downstream end of the tray in the sheet feed direction. The separation plate comprises an inclined surface that is inclined with respect to the holding surface of the tray, a plurality of separation portions configured to separate the particular sheet fed by the feed unit from other sheets of the plurality of sheets held by the tray, wherein at least one of the separation portions projects a first distance from the inclined surface, and the plurality of separation portions is positioned at predetermined intervals in the sheet feed direction, and a particular projection positioned on the inclined surface and configured to project a second distance from the inclined surface, wherein the second distance is greater than the first distance, and the plurality of separation portions comprises a first separation portion positioned upstream of the particular projection in the sheet feed direction, and a second separation portion positioned downstream of the particular projection in the sheet feed direction.

According to another embodiment of the invention, an image forming apparatus comprises a sheet feed device comprising a tray comprising a holding surface configured to hold a plurality of sheets, a feed unit configured to contact a particular sheet of the plurality of sheets, and to feed at least the particular sheet from the tray in a sheet feed direction, and a separation plate positioned at a downstream end of the tray in the sheet feed direction. The separation plate comprises an inclined surface that is inclined with respect to the holding surface of the tray, a plurality of separation portions configured to separate the particular sheet fed by the feed unit from other sheets of the plurality of sheets held by the tray, wherein at least one of the plurality of separation portions projects a first distance from the inclined surface, and the plurality of separation portions is positioned at predetermined intervals in the sheet feed direction, and a particular projection positioned on the inclined surface and configured to project a second distance from the inclined surface, wherein the second distance is greater than the first distance. The image recording apparatus also comprises a recording unit configured to record an image on the particular sheet fed by the sheet feed device, and a sheet discharge unit configured to discharge the particular sheet with an image recorded thereon from the recording unit. The plurality of separation portions comprises a first separation portion positioned upstream of the particular projection in the sheet feed direction, and a second separation portion positioned downstream of the particular projection in the sheet feed direction.

Other advantages of the invention will be apparent to persons of ordinary skill in the art in view of the following detailed description of the invention and the accompanying drawings.

BRIEF DESCRIPTION OF THE DRAWINGS

For a more complete understanding of the invention, and the needs satisfied thereby, reference now is made to the following descriptions taken in connection with the accompanying drawings.

DETAILED DESCRIPTION OF EMBODIMENTS

Embodiments of the invention may be understood by referring to FIGS. 1-14, like numerals being used for like corresponding parts in the various drawings.

Figure 1:
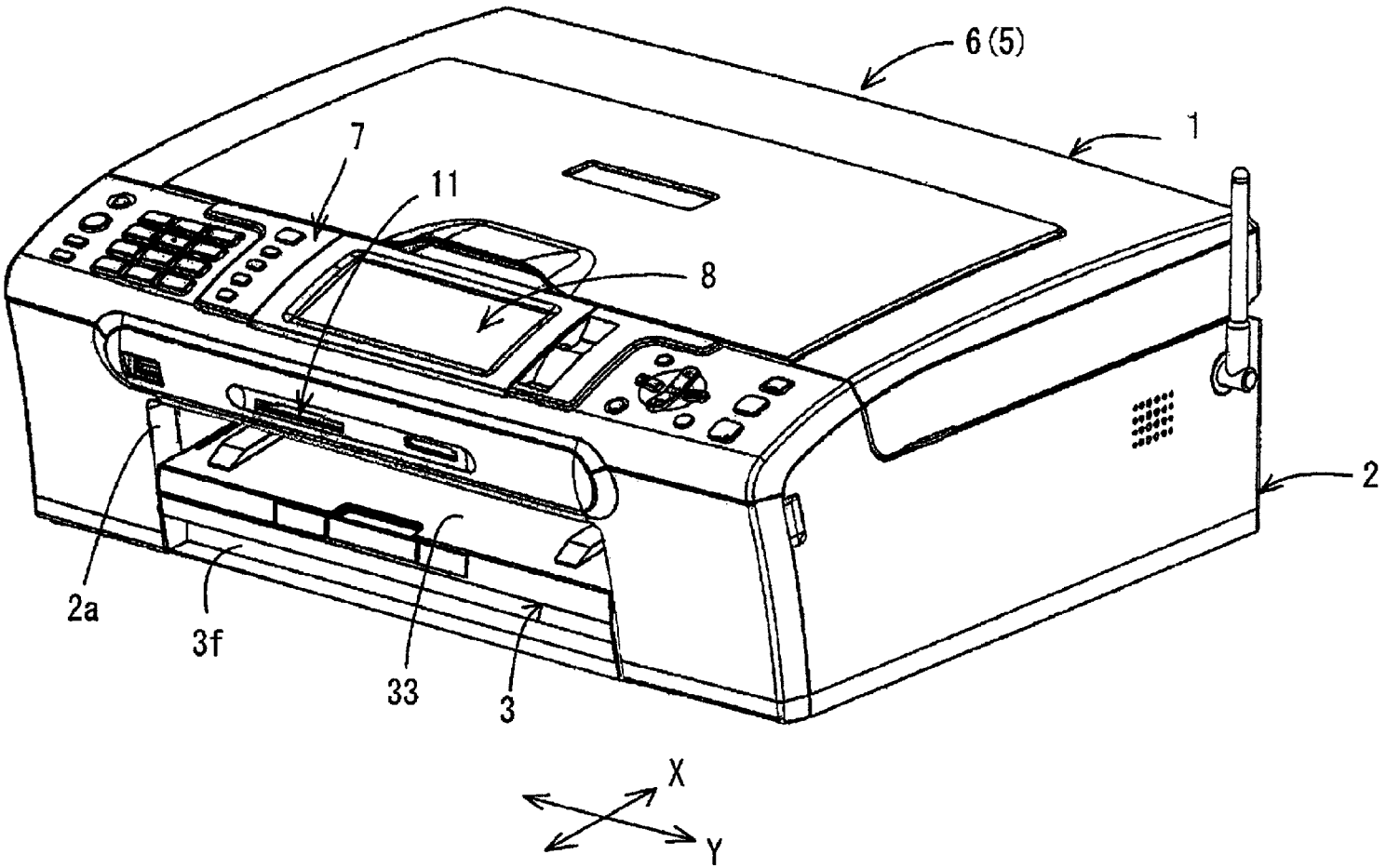
FIG. 1 is a perspective view of an image recording apparatus according to an embodiment of the invention.

FIG. 1 shows an image recording apparatus 1 according to an embodiment of the invention. The image recording apparatus 1 is a multi-function device (MFD) that has printing, copying, scanning, or facsimile functions, or any combination thereof. As shown in FIG. 1, the image recording apparatus 1 comprises a housing 2. An opening 2*a* is formed in the front of the housing 2. A feed tray 3 for storing therein recording mediums, e.g., sheets are mounted in the opening 2*a*, such that it is selectively inserted into and removed from the opening 2*a* in an X-axis direction.

An image reading device 5 is positioned, on an upper portion of the housing 2, for reading a document during a copying and/or a facsimile operation of the image recording apparatus 1. The image reading device 5 is vertically pivotable about a pivot located at one end of the housing 2. A glass plate is positioned at the top of the image reading device 5, and is covered by a document cover 6 which is vertically pivotable about a pivot located at a rear end of the image reading device 5. A document is positioned on the glass plate by opening the document cover 6 upward. A scanner, e.g., a contact image sensor, reads an image of the document while reciprocating under the glass plate in a Y-axis direction.

An operation panel 7 is positioned at the top of the housing 2 and in front of the document cover 6, and comprises a plurality of operation buttons and a display device 8, e.g., a liquid crystal display. The operation buttons comprise a start button (not shown) and a stop button (not shown) and are selected to execute various operations. The display device 8 displays setting conditions of the image recording apparatus 1 and operation messages.

A memory slot 11 for receiving external memories is positioned at the front of the housing 2, on an upper side of the opening 2*a*. The external memories may be, for example, a Compact Flash®, a Smart Media®, a Memory Stick®, a SD card®, and/or a xD card®. Data stored in an external memory inserted in the memory slot 11 may be read into an internal memory of the image recording device 1, and may be printed on a sheet by a recording unit 10.

Figure 2:
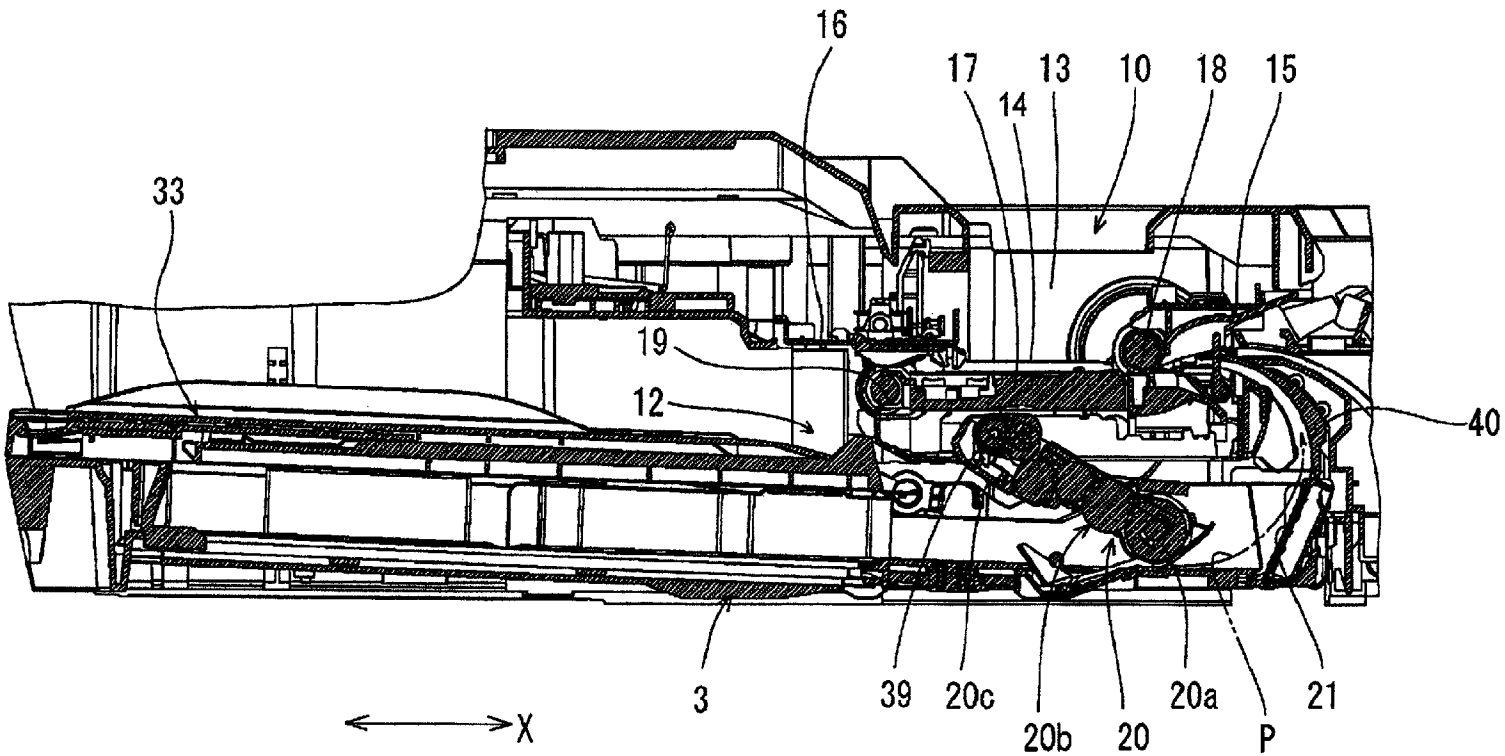
FIG. 2 is a side, cross-sectional view of a recording unit and a sheet feed device of the image recording apparatus of FIG. 1.

As shown in FIG. 2, the recording unit 10 is supported by a main frame (not shown) having an upwardly open box structure, and a first guide member 15 and a second guide member 16 which comprise elongate plates which are supported by side plates of the main frame and extend in the main scanning direction. A carriage 13, on which a recording head 14 of the recording unit 10 is mounted, is supported by the first guide member 22 located upstream of the carriage 13 in a sheet feed direction and the second guide member 16 located downstream of the carriage 13, such that the carriage 13 is slidably movable on the first guide member 22 and the second guide member 23. Thus, the carriage 13 is reciprocally movable in the Y-axis direction.

In order to reciprocally move the carriage 13, a timing belt (not shown) is positioned on an upper surface of the second guide member 16. The timing belt extends in the Y-axis direction and is wound around pulleys (not shown). A carriage motor (not shown) configured to drive the timing belt is fixed to a lower surface of the second guide member 16.

A platen 17 has a flat shape and extends in the Y-axis direction to face an underside of the recording head 14 on the carriage 13. The platen 17 is fixed above a bottom plate of the main frame between the first guide member 15 and the second guide member 16.

As shown in FIG. 2, a pair of register rollers (convey rollers) 18 are positioned upstream of the platen 17 in the sheet feed direction to convey the sheet to the underside of recording head 14, and a pair of discharge rollers 19 are positioned downstream of the platen 17 to discharge the printed sheet to a discharge tray 33 positioned at an upper surface of the feed tray 3. The platen 17 supports the sheet conveyed by the register rollers 18, such that a distance between the sheet and the recording head 14 is maintained constant.

Recording mediums stored in the feed tray 3, which are referred to as "sheets", include plain paper, thick paper, e.g., postcards and envelops, specialized paper, e.g., glossy paper, and resin films.

Referring to FIG. 2, a sheet feed device 12 according to an embodiment of the invention is depicted. The feed tray 3, which may be made of synthetic resin by injection molding, comprises an inner storing portion 3*b* and an outer storing portion 3*d* which is extendably connected to the inner storing portion 3*b*. When the outer storing portion 3*b* is extended outward with respect to the inner storing portion 3*b* so as to increase the overall length of the feed tray 3, sheets up to A3 size may be stored on the inner storing portion 3*b* and the outer storing portion 3*d* while a longer side of the sheets extends in the X-axis direction and a shorter side extends in the Y-axis direction. When the outer storing potion 3*d* is pushed into the inner storing portion 3*b* so as to decrease the overall length of the feed tray 3, sheets of A4 size may be stored in the feed tray 3.

A pendulum-type feed unit 20 feeds a sheet from the feed tray 3, via a U-shaped feed path 40, to the recording unit 10. The U-shaped feed path 40 changes the sheet feed direction. The feed unit 20 feeds the sheet from the feed tray 3 to the U-shaped feed path 40 in a first direction along the X-axis, and feeds the sheet from the U-shaped feed path 40 to the recording unit 10 in a second direction opposite the first direction.

Figure 3:
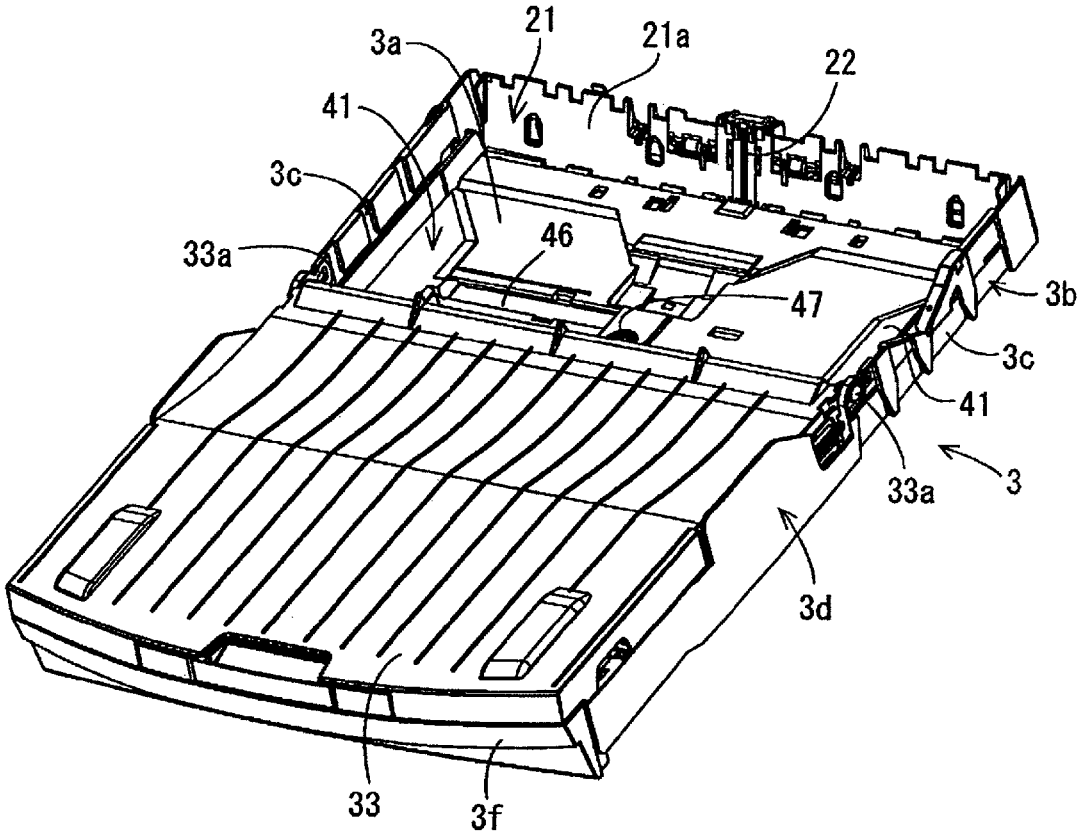
FIG. 3 is a perspective view of a sheet tray of the sheet feed device of FIG. 2.

As shown in FIG. 3, the inner storing portion 3*b* comprises a bottom plate 3*a*, opposed side plates 3*c*, and an inclined separation plate 21 positioned at an downstream end of the feed tray 3 in the sheet feed direction. The outer storing portion 3*d* comprises a bottom plate (not shown) and opposed side plates (not shown). A handle portion 3*f* is positioned at an outermost end of the outer storing portion 3*d*. The maximum capacity of the feed tray 3 may be about 150 sheets of plain paper, or a stack, e.g., a plurality, of sheets having a height of about 15 mm.

The discharge tray 33, which may be made of synthetic resin by injection molding, is connected to the opposed side plates of the outer storing portion 3*d*, via a pivot 33*a*, so as to be vertically pivotable. The discharge tray 33 is placed horizontally on the opposed side plates of the outer storing portion 3*d*, and is extendable together with the outer storing portion 3*d* from the opening 2*a*.

The inner storing portion 3*b* of the feed tray 3 comprises a pair of side guides 41. The side guides 41 extend in the sheet feed direction (X-axis direction), and position and guide side edges of the sheets stored in the inner storing portion 3*b*. The outer storing portion 3*d* of the feed tray 3 comprises a tail guide (not shown) that is movable in the X-axis direction so as to contact trailing edges of the sheets.

The side guides 41 are positioned on the bottom plate 3*a* between the opposed side plates 3*c* and are slidable in the Y-axis direction such that the distance therebetween is increased and decreased. Each of the side guides 41 comprises a slider 43 and a stopper 42, and one of the side guides 41 comprises a lock member (not shown) with a handle.

Each slider 45 is slidable along an upper surface of the bottom plate 3*a* and supports a lower surface of the sheets. The stopper stands upright, and contacts the side edges of the sheets.

Racks 46 connected to the side guides 41 engage a pinion 47 positioned at a widthwise center (center in the Y-axis direction) of the feed tray 3. Thus, the distance between the side guides 41 are adjusted, such that a widthwise centerline of the feed tray 3 aligns with a widthwise centerline of the sheets.

The lock member is configured to engage one of teeth formed in the upper surface of the bottom plate 3*a*. When the handle is operated, the lock member is released from the bottom plate 3*a*.

As shown in FIG. 2, the feed unit 20 comprises an arm 20*c* which may be vertically pivotable about a drive shaft 39. The arm 20*c* extends toward the inclined separation plate 21. Feed rollers 20*a* are positioned at a free end of the arm 20*c*, and are driven by the drive shaft 39 via a gear transmission mechanism 20*b*. In this embodiment, a pair of feed rollers 20*a* is positioned symmetrically about a line passing through the Y-axis center.

A pair of friction members, e.g., cork plates, is fixed to an upper surface of the bottom plate 3*a* of the feed tray 3 to receive the pair of feed rollers 20*a* when the arm 20*c* pivots downward. This prevents two or more sheets from being fed together by the feed rollers 20*a* when only a small number of sheets are left in the feed tray 3.

Separation portions 23 are positioned on an inner surface 21*a* of the inclined separation plate 21 at a central portion of the inclined separation plate 21 in the Y-axis direction, e.g., in a widthwise direction of the sheet. The separation portions 23 are positioned at intervals, in the sheet feed direction from an upstream side (side closer to the bottom plate 3*a*) toward a downstream side (side remoter from the bottom plate 3*a*) and project from the inner surface 21*a*.

Figure 6B:
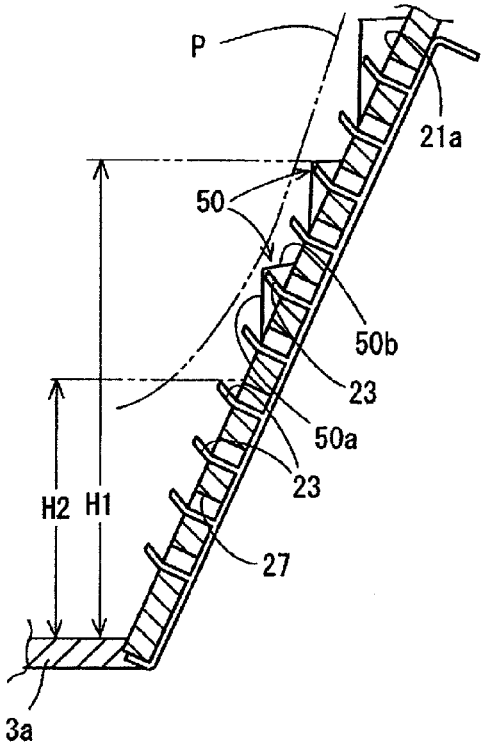
FIG. 6B is a cross-sectional view of the inclined separation plate of FIG. 5 taken along line VIB-VIB.
Figure 7:
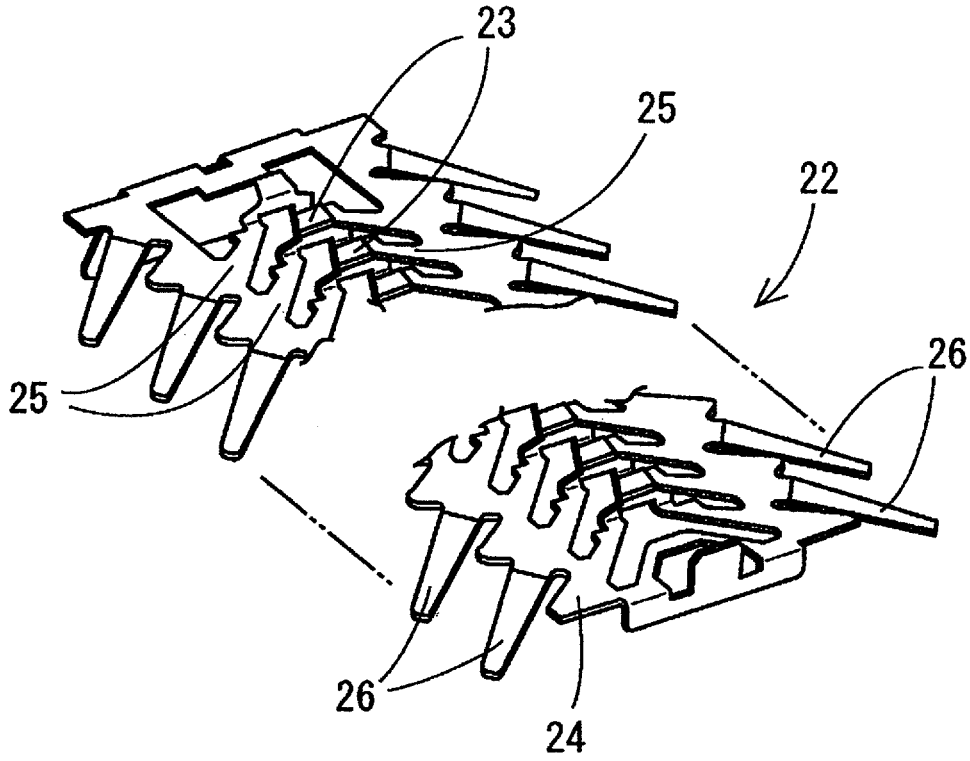
FIG. 7 is a perspective view of a separation member according to an embodiment of the invention.

As shown in FIG. 7, a separation member 22 may comprise an elastic member, e.g., a metal spring plate, and may have a flat elongated shape. The separation member 22 comprises a base 24, arms 25, the separation portions 23, and elastic legs 26. Pairs of arms 25 are formed in a row on the flat base 24, and may be raised from the base 24. Each separation portion 23 is formed at a free end of a pair of arms 25. As shown in FIG. 6B, each separation portion 23 has a V-shape cross-section as viewed from a side of the inclined separation plate 21, e.g., as viewed from a direction perpendicular to the sheet feed direction. Each separation portion 23 may be inclined toward a downstream side in the sheet feed direction. The elastic legs 26, which generate elasticity, e.g., apply an urging force, are formed on both sides of the base 24 and may project downward slantingly. The separation member 22 may be formed by stamping and bending a metal sheet.

Figure 4:
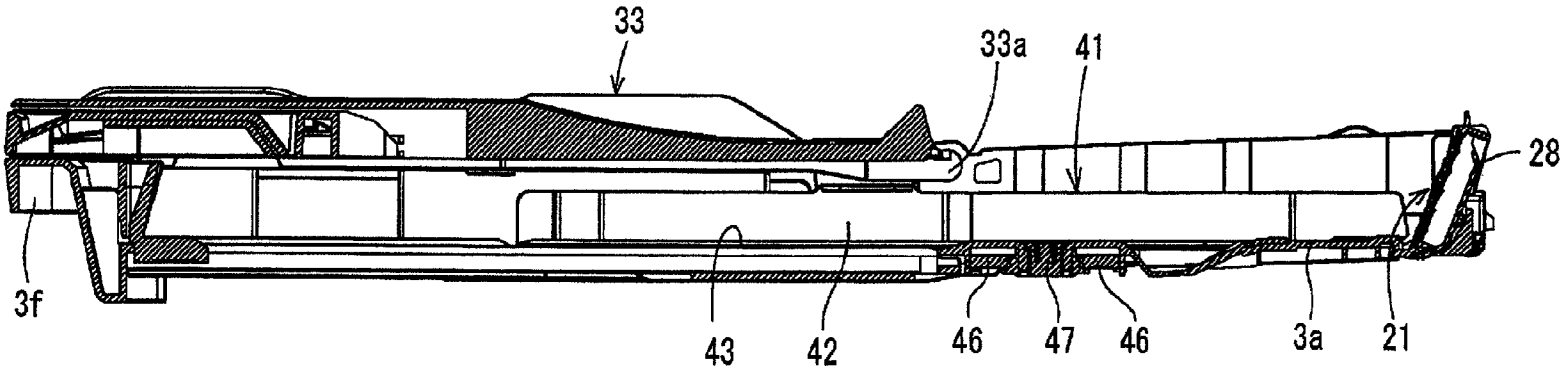
FIG. 4 is a side cross-sectional view of the sheet tray of FIG. 3.
Figure 5:
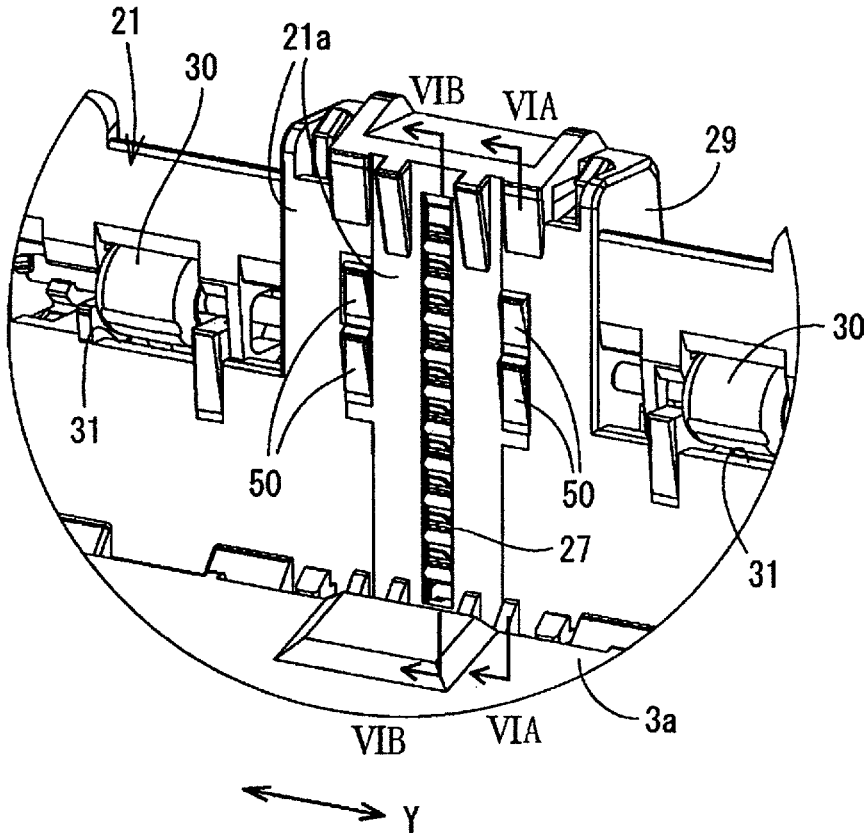
FIG. 5 is an enlarged perspective view of projections of an inclined separation plate, according to an embodiment of the invention.

As shown in FIGS. 4-6, the inclined separation plate 21 is removably attached to an innermost end, e.g., a right end as shown in FIG. 2, of the feed tray 3. The inclined separation plate 21 and the feed tray 3 may be made of synthetic resin by injection molding. The inclined separation plate 21 may comprise a single plate. The inclined separation plate 21 is inclined with respect to the bottom plate 3*a* and may be substantially convex. Separation plate 21 may project at substantially the center thereof in the Y-axis direction, e.g., in a widthwise direction of the sheet, and may retract at both ends thereof in the Y-axis direction. The separation member 22 is attached to the Y-axis center of the inclined separation plate 21 from behind, e.g., from an outer surface of the inclined separation plate 21.

As shown in FIGS. 5 and 6B, holes 27 for receiving the arms 25 and the separation portions 23 are formed in the inclined separation plate 21 in a row in the sheet feed direction, at intervals that correspond to the intervals of the arms 25 and the separation portions 23. A box-shaped support member 28 for supporting the separation member 22 is received by a case 29 that may be integrally formed with the outer surface of the inclined separation plate 21. The support member 28 may comprise a synthetic resin.

Figure 8:
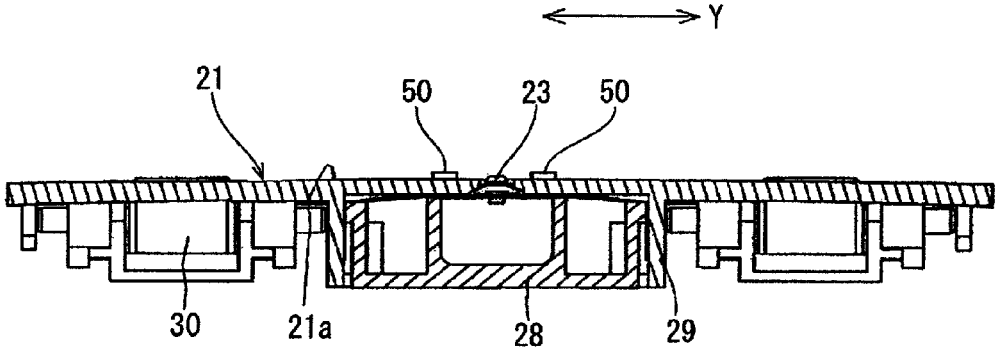
FIG. 8 is a horizontal cross-sectional view of the inclined separation plate of FIG. 5.

When the separation member 22 is inserted into the case 29, such that the separation portions 23 are fitted into the holes 27, and the supporting member 28 is attached to the case 29, the elastic legs 26 may be supported by the supporting member 28. Consequently, as shown in FIG. 8, the base 24 may contact the outer surface of the inclined separation plate 21, and the separation portions 23 may project, through the holes 27, from the inner surface 21*a* by a predetermined distance.

Figure 6A:
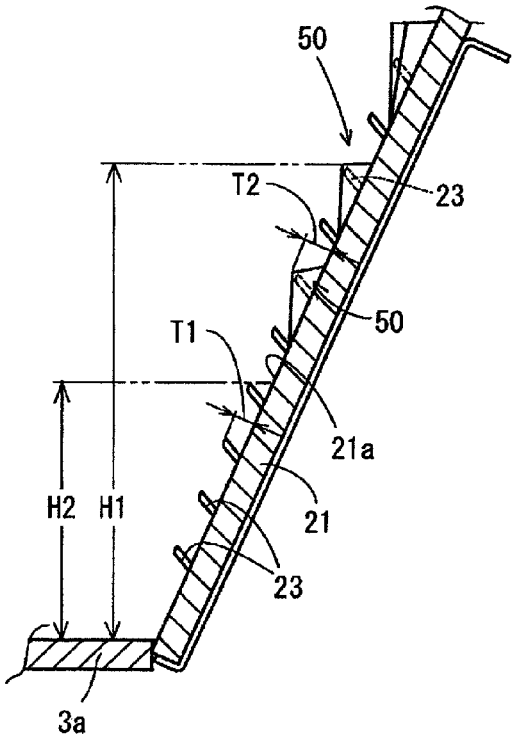
FIG. 6A is a cross-sectional view of the inclined separation plate of FIG. 5 taken along line VIA-VIA.

As shown in FIGS. 6A and 6B, the maximum stacking height H2, which may be used for specialized paper, for inkjet printing may be set lower than the maximum stacking height H1, which may be used for plain paper. The maximum stacking heights H1, H2 are measured from an upper surface of the bottom plate 3*a*. The specialized paper includes, for example, glossy paper suitable for photo printing, coated paper with an ink absorptive layer, and the like. Such specialized paper is generally more rigid than plain paper, and a calendered or coated surface of the specialized paper may have a higher coefficient of friction than the plain paper. A sheet drawing force of the feed rollers 20*a* may be adjusted by limiting the maximum stacking height H2, which may allow the feed rollers 20*a* to feed such specialized paper. If the specialized paper is stacked too high, an angle formed by an uppermost sheet in the feed tray 3 and a line connecting the drive shaft 39 and a contact point of the feed roller 20*a* with the uppermost sheet may become too small. This may cause the feed rollers 20*a* to rotate without feeding any sheets.

Moreover, if the U-shaped feed path 40 has a relatively small radius of curvature, then when an uppermost sheet P is fed by the feed rollers 20*a* and the separation portions 23 from the stack, e.g., the plurality of sheets, which is within the maximum stacking height H2, a surface of the upper most sheet P may be pressed against the separation portions 23 positioned at a predetermined height from the upper surface of the bottom plate 3*a*. In this instance, separation portions 23 may scratch or otherwise damage a calendered or coated surface of the sheet P.

In order to prevent damage to the surface of the sheet P by the separation portions, projections 50 may be formed on the upper surface 21*a* of the inclined separation plate 21 at positions downstream of the maximum stacking height H2 in the sheet feed direction. The separation portions 23 project from the upper surface 21*a* by a distance T1, and the projections 50 project from the upper surface 21*a* by a distance T2 that is greater than the distance T1. The projections 50 may be formed integrally with the inclined separation plate 21 when the inclined separation plate 21 is made of synthetic resin by injection molding. The maximum stacking height H2 may be selected relative to one or more of the angle of inclination of the inclined separation plate 21 with respect to the bottom plate 3*a*, the projected distance of the separation portions 23, the radius of curvature of the U-shaped feed path 40, the sheet drawing force of the rollers 20*a*, and the like.

As shown in FIGS. 5, 6A, and 6B, two projections 50 may be positioned vertically on each side of the row of separation portions 23. More specifically, in an embodiment of the invention, four projections 50 are formed on the upper surface 21*a* at positions downstream of the maximum stacking height H2 in the sheet feed direction. One projection 50 may be formed on each side of the sixth separation portion 23 when counting from the bottom plate 3*a*, and one projection 50 may be formed on each side of the eighth separation portion 23. These projections 50 are formed at a substantially central portion of the inclined separation plate 21 in the Y-axis direction, e.g., in a widthwise direction of the sheet. When the sheet P is fed from the feed tray 3 toward the feed path 40 while being bent, the projections 50 may prevent tips of separation portions 23 from contacting a surface of the sheet P, when separation portions 23 are positioned downstream of the position at which the sheet P is staked in the feed tray 3.

Each of the projections 50 has a substantially triangular cross-section as viewed from a side of the inclined separation plate 21, e.g., as viewed from a direction perpendicular to the sheet feed direction. The projection 50 may have a trapezoidal cross-section as viewed from the side of the inclined separation plate 21. In other words, the projection 50 may have a substantially triangular outline or may have a substantially trapezoidal outline as viewed from the side of the inclined separation plate 21. The sixth separation portion 23 may be aligned with the associated projection 50, e.g., within the outline of the associated projection 50, as viewed from the side of the inclined separation plate 21. Moreover, the eighth separation portion 23 also may be aligned with the associated projection 50, e.g., within the outline of the associated projection 50, as viewed from the side of the inclined separation plate 21.

The projection 50 has a first sloping surface, e.g., first slope 50*a*, positioned upstream in the sheet feed direction and a second sloping surface, e.g., second slope 50*b*, positioned downstream in the sheet feed direction. The inclination of the first sloping surface, e.g., first slope 50*a*, with respect to the upper surface 21*a* is relatively slight while the inclination of the second slop 50*b* with respect to the upper surface 21*a* is relatively steep. In an embodiment of the invention, an angle formed between the first sloping surface, e.g., first slope 50*a*, and the upper surface 21*a* may be greater than an angle formed between the second sloping surface, e.g., second slope 50*b*, and the upper surface 21*a*. Accordingly, a contact angle of the leading edge of the sheet P with the first sloping surface, e.g., first slope 50*a*, may be relatively small, e.g., slightly greater than a contact angle of the leading edge of the sheet P with the upper surface 21*a*. This configuration may reduce a resistance to feed of the sheet P and may allow the sheet P to be guided smoothly toward the feed path 40.

In addition, a distance by which the projection 50 located upstream in the sheet feed direction projects from the upper surface 21*a* may be greater than a distance by which the projection 50 located downstream projects from the upper surface 21*a*. A bent surface of the sheet P may contact the upstream projections 50 earlier than the bent surface of the sheet P may contact the downstream projections 50, and the upstream projections 50 may prevent the bent surface from contacting the separation portions 23 positioned downstream of the position at which the sheet P is stacked in the feed tray 3.

As shown in FIG. 5, a flat strip of the upper surface 21*a* is positioned between the row of separation portions 23 and the two projections 50 formed on one side of the row of separation portions 23, and another flat strip of the upper surface 21*a* is positioned between the row of separation portions 23 and the two projections 50 formed on the other side of the row of separation portions 23. This allows one probe of a bifurcated probe unit to accurately measure the height of each separation portion 23, while the other probe may slide on the flat strip of the upper surface 21*a*.

Figure 9:
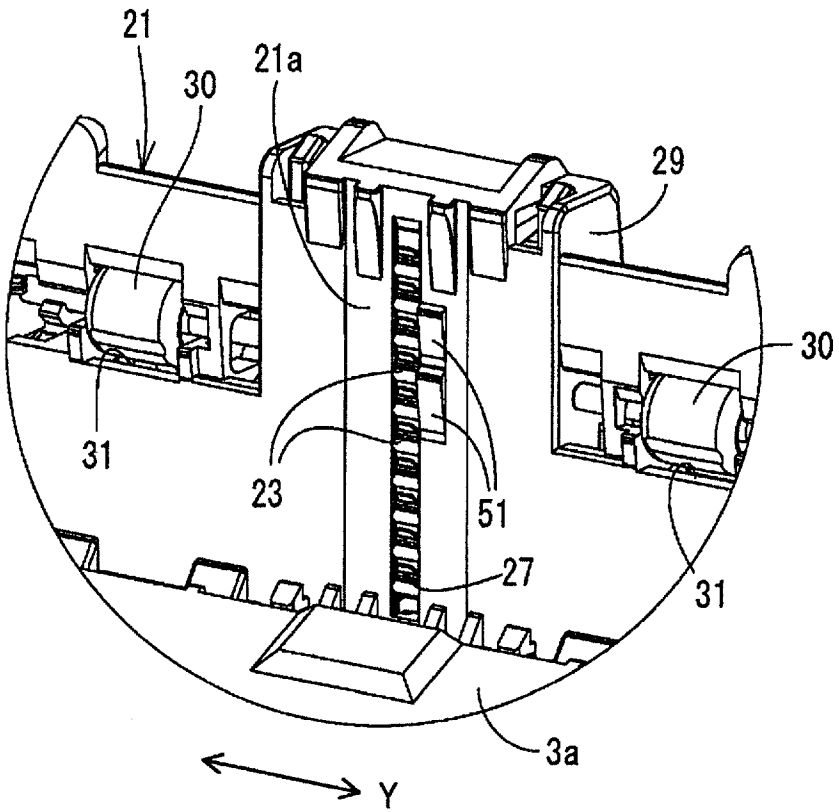
FIG. 9 is an enlarged perspective view of projections of an inclined separation plate according to another embodiment of the invention.

FIG. 9 shows another embodiment where two projections 51 may be formed on the upper surface 21*a* at positions downstream of the maximum stacking height H2 in the sheet feed direction. The two projections 51 are positioned substantially vertically. One of the projections 51 may be formed adjacent to the sixth separation portion 23 when counting from the bottom plate 3*a*. The other of the two projections 51 may be formed adjacent to the eighth separation portion 23. Although the projections 51 may be formed only on one side of the row of separation portions 23, the projections 51, which are formed in close proximity of the sixth and eighth separation portions 23, may prevent a surface of the sheet P, which has a relatively high rigidity compared to other types of sheets, from contacting the separation portions 23 positioned downstream of the position at which the sheet P is stacked in the sheet tray 3.

Figure 10:
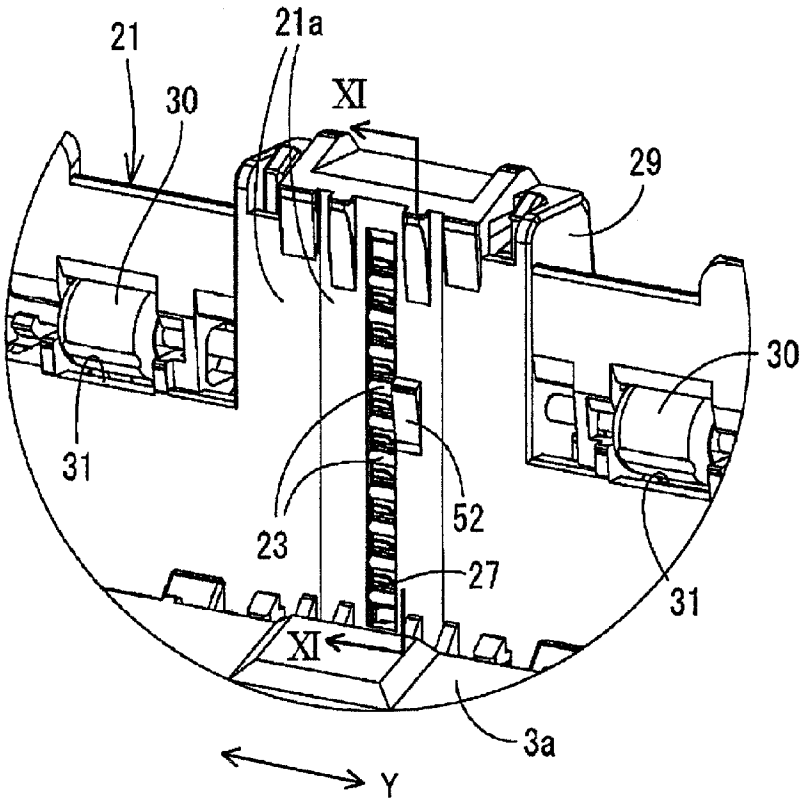
FIG. 10 is an enlarged perspective view of projections of an inclined separation plate according to still another embodiment of the invention.
Figure 11:
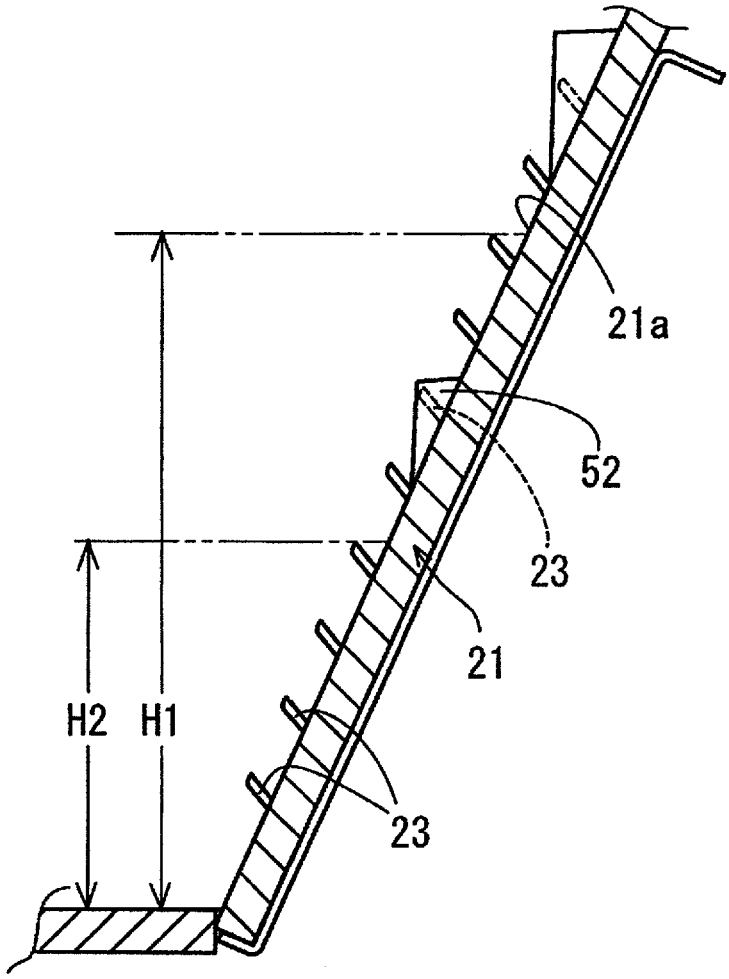
FIG. 11 is a cross-sectional view of the inclined separation plate of FIG. 10 taken along line XI-XI.

FIGS. 10 and 11 show another embodiment of the invention in which a projection 52 may be formed on the upper surface 21*a* at a position downstream of the maximum stacking height H2 in the sheet feed direction. The projection 52 may be formed on one side of the row of separation portions 23 in close proximity of the sixth separation portion 23 when counting from the bottom plate 3*a*.

In an embodiment of the invention, e.g., in the embodiments shown in FIGS. 9 and 10, a flat strip of the upper surface 21*a* without any projection 51, 52 may extend on the other side of the row of separation portions 23. This may allow one probe of a bifurcated probe unit to accurately measure the height of each separation portion 23 while the other probe slides on the flat strip, as shown in the embodiment shown in FIG. 5.

Figure 12:
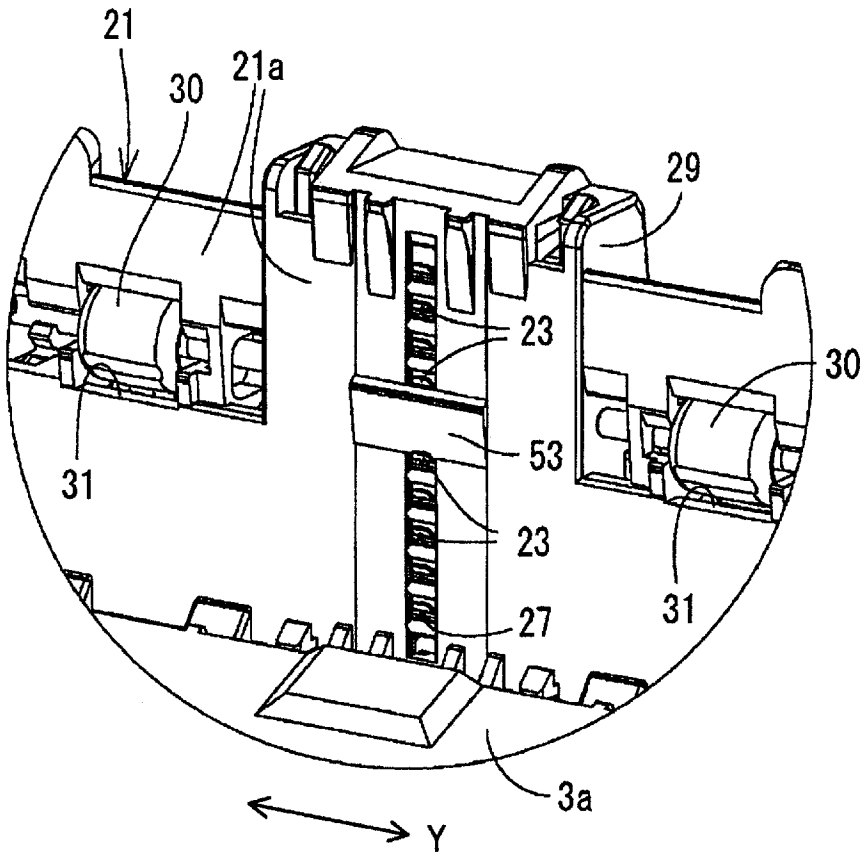
FIG. 12 is an enlarged perspective view of projections of an inclined separation plate according to yet another embodiment of the invention.

FIG. 12 shows yet another embodiment, in which a projection 53 is formed on the upper surface 21*a* at a position downstream of the maximum stacking height H2 in the sheet feed direction, such that the projection 53 may intersect the row of separation portions 23. The projection 53 may extend in a direction perpendicular to the row of separation portions 23 and may substantially cover the sixth separation portion 23 when counting from the bottom plate 3*a*. In an embodiment, the inclined separation plate may comprise a synthetic resin, and the projection 53 may be integrally formed with the inclined separation plate 21 when the inclined separation plate 21 is formed by injection molding, thereby improving the rigidity of the inclined separation plate 21.

Figure 13:
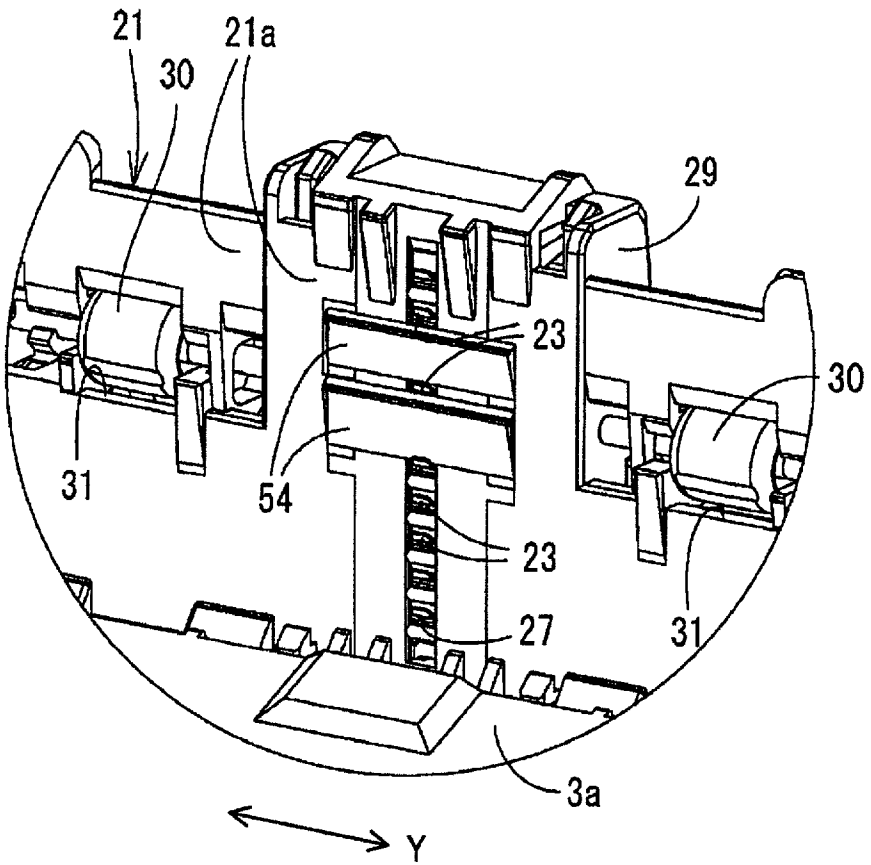
FIG. 13 is an enlarged perspective view of projections of an inclined separation plate according to yet another embodiment of the invention.

FIG. 13 shows another embodiment in which two projections 54 are formed on the upper surface 21*a* at positions downstream of the maximum stacking height H2 in the sheet feed direction, such that projections 54 intersect the row of separation portions 23. The projections 54 extend in a direction perpendicular to the row of separation portions 23 and may cover at least a portion of the sixth and eighth separation portions 23, when counting from the bottom plate 3*a*, respectively. In an embodiment, the inclined separation plate may comprise a synthetic resin, and the projection 54 may be integrally formed with the inclined separation plate 21 when the inclined separation plate 21 is formed by injection molding, thereby improving the rigidity of the inclined separation plate 21.

Figure 14:
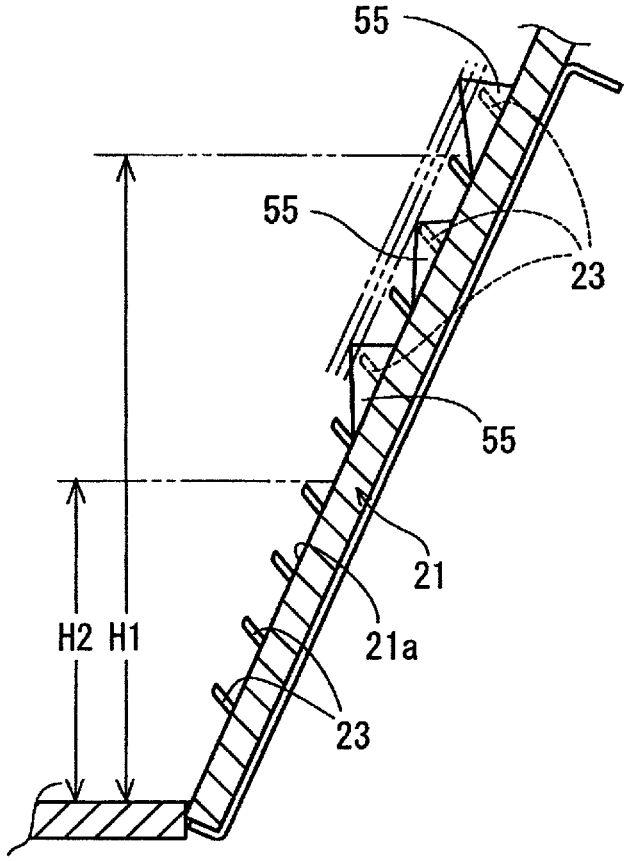
FIG. 14 is an enlarged perspective view of projections of an inclined separation plate according to still yet another embodiment of the invention.

FIG. 14 shows another embodiment in which three projections 55 may be formed vertically along the row of separation portions 23 at positions downstream of the maximum stacking height H2 in the sheet feed direction. The most upstream projection 55 and the most downstream projection 55 relative to the other projections 55 may project a greater distance than the other projections 55. Moreover, an imaginary line passing the most projected point of each of the three projections 55 may correspond to a bent surface of the sheet P as sheet P is fed from the feed tray 3 to the feed path 40. In an embodiment of the invention, the projected distance of the most downstream projection 55 may be greater than the projected distance of the most upstream projection 55.

Similarly to the embodiment shown in FIG. 5, each of the projections 51-55 may have a first sloping surface, e.g., first slope, located upstream in the sheet feed direction and a second sloping surface, e.g., second slope, located downstream in the sheet feed direction. An angle formed between the first sloping surface, e.g., first slope, and the upper surface 21 a may be greater than an angle formed between the second sloping surface, e.g., second slope, and the upper surface 21*a*. Accordingly, the projections 51-55 may have a similar effect as the projection 50 shown in FIG. 5.

In embodiments in which two or more projections 50, 51, 54, 55 are formed along the row of separation portions 23, the projections 50, 51, 54, 55 may be formed such that at least one separation portion 23 is interposed between adjacent two projections 50, 51, 54, 55, as viewed from a side of the inclined separation plate 21, e.g., as viewed from a direction perpendicular to the sheet feed direction.

In an embodiment of the invention, feed tray 3 may be a center registration type feed tray, in which the widthwise center of the sheets guided by the pair of side guides 41 remains at the same position regardless of the size of sheet guided, the projections 50-55 may be formed at a central portion of the inclined separation plate 21 in the Y-axis direction, e.g., in a widthwise direction of the sheet.

In each of the embodiments shown in FIGS. 5, 9, 10, 12, and 13, the inclined separation plate 21 may have holes 31 formed therethrough at positions outside the case 29, such that the projections 50-54 may be interposed between the holes 31. Rollers 30, which may comprise synthetic resin, are placed in the holes 31 to facilitate feeding of the sheet, and shafts of the rollers 30 are rotatably supported by bearings formed at an outer surface of the inclined separation plate 21. The projections 50-54 may be interposed between the row of separation portions 23 and one of the rollers 30. The rollers 30 may project from the upper surface 21*a* substantially the same distance as the projections 50-54 project, and may be aligned, in a direction perpendicular to the sheet feed direction, with the projections 50-54 associated with the sixth separation portion 23, or the projections associated with the eighth separation portion 23.

In embodiments, e.g., in the above-described embodiments, in which the inclined separation plate 21 comprises synthetic resin, the projections 50-55 may be integrally and simultaneously formed with the inclined separation plate 21 by injection molding.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A sheet feed device comprising:

a holding surface configured to hold a plurality of sheets;

a feed unit configured to contact a particular sheet of the plurality of sheets and to feed at least the particular sheet in a sheet feed direction;

a guide plate disposed downstream of the holding surface in the sheet feed direction and comprising an inclined surface which is inclined with respect to the holding surface and is configured to guide the particular sheet fed by the feed unit, the guide plate having a hole formed therethrough;

a separation member extending through the hole and extending beyond the inclined surface and beyond an opposite surface of the guide plate from the inclined surface, wherein the separation member comprises a plurality of first projections arranged in a first row in the sheet feed direction and each projecting in an inward direction from the hole of the guide plate, the inward direction being toward edges of the plurality of sheets when the holding surface holds the plurality of sheets;

an elastic member configured to urge the plurality of first projections in the inward direction; and a plurality of second projections arranged in a second row parallel to the first row and projecting in the inward direction relative to the inclined surface of the guide plate, wherein the plurality of first projections of the separation member extending through the hole project by a first distance relative to the inclined surface, and the plurality of second projections project by a second distance relative to the inclined surface, the second distance being greater than the first distance.

2. The sheet feed device according to claim 1, wherein the plurality of second projections are integrally formed with the guide plate.

3. The sheet feed device according to claim 1, wherein the plurality of second projections are stationary relative to the inclined surface of the guide plate.

4. The sheet feed device according to claim 1, wherein the plurality of second projections comprise a synthetic resin.

5. The sheet feed device according to claim 1, wherein the elastic member comprises metal.

6. The sheet feed device according to claim 5, wherein the elastic member comprises an elastic leg.

7. The sheet feed device according to claim 1, wherein the plurality of first projections are arranged at first intervals, and the plurality of second projections are arranged at second intervals which are greater than the first intervals.

8. The sheet feed device according to claim 1, wherein the feed unit comprises at least one feed roller configured to contact the particular sheet of the plurality of sheets and having a predetermined width between one end and the other end of the at least one feed roller, the predetermined width being perpendicular to the sheet feed direction, and wherein the plurality of first projections and the plurality of second projections are located within the predetermined width of the at least one feed roller.

9. The sheet feed device according to claim 1, wherein the plurality of first projections are positioned at a center with respect to a width direction of the holding surface, the width direction being perpendicular to the sheet feed direction.

10. The sheet feed device according to claim 1, wherein the elastic member is integrally formed with the separation member.

11. A sheet feed device comprising:

a holding surface configured to hold a plurality of sheets;

a feed unit configured to contact a particular sheet of the plurality of sheets and to feed at least the particular sheet in a sheet feed direction;

a guide plate disposed downstream of the holding surface in the sheet feed direction and comprising an inclined surface which is inclined with respect to the holding surface and is configured to guide the particular sheet fed by the feed unit, the guide plate having a hole formed therethrough;

a separation member extending through the hole and extending beyond the inclined surface and beyond an opposite surface of the guide plate from the inclined surface, wherein the separation member comprises a plurality of first projections arranged in a first row in the sheet feed direction and each projecting in an inward direction relative to the inclined surface of the guide plate, the inward direction being toward edges of the plurality of sheets when the holding surface holds the plurality of sheets;

an elastic member configured to urge the plurality of first projections in the inward direction; and a plurality of second projections arranged in a second row parallel to the first row and projecting in the inward direction relative to the inclined surface of the guide plate, wherein the plurality of first projections of the separation member extending through the hole project by a first distance relative to the inclined surface, and the plurality of second projections project by a second distance relative to the inclined surface, the second distance being greater than the first distance.

12. The sheet feed device according to claim 11, wherein the elastic member comprises metal.

13. The sheet feed device according to claim 12, wherein the plurality of first projections are arranged at first intervals, and the plurality of second projections are arranged at second intervals which are greater than the first intervals.

14. The sheet feed device according to claim 13, wherein the plurality of first projections are positioned at a center with respect to a width direction of the holding surface, the width direction being perpendicular to the sheet feed direction.

15. The sheet feed device according to claim 13, wherein the elastic member is integrally formed with the separation member.

* * * * *